US012215916B2

(12) United States Patent
Wiedenmann et al.

(10) Patent No.: US 12,215,916 B2
(45) Date of Patent: Feb. 4, 2025

(54) HEAT EXCHANGER ASSEMBLY FOR A REFRIGERATION DEVICE, AND REFRIGERATION DEVICE COMPRISING SAME

(71) Applicant: BSH Hausgeraete GmbH, Munich (DE)

(72) Inventors: Felix Wiedenmann, Oepfingen (DE); Ming Zhang, Ulm (DE)

(73) Assignee: BSH Hausgeraete GmbH, Munich (DE)

( * ) Notice: Subject to any disclaimer, the term of this patent is extended or adjusted under 35 U.S.C. 154(b) by 194 days.

(21) Appl. No.: 17/923,034

(22) PCT Filed: Apr. 27, 2021

(86) PCT No.: PCT/EP2021/060935
§ 371 (c)(1),
(2) Date: Nov. 3, 2022

(87) PCT Pub. No.: WO2021/224060
PCT Pub. Date: Nov. 11, 2021

(65) Prior Publication Data

US 2023/0221056 A1 Jul. 13, 2023

(30) Foreign Application Priority Data

May 7, 2020 (DE) ..... 10 2020 205 750.8

(51) Int. Cl.

| | |
|---|---|
| ***F25D 21/14*** | (2006.01) |
| ***F25B 39/04*** | (2006.01) |
| *F28D 1/02* | (2006.01) |
| *F28F 17/00* | (2006.01) |

(52) U.S. Cl.
CPC ..... *F25D 21/14* (2013.01); *F25B 39/04* (2013.01); *F28D 1/024* (2013.01); *F28F 17/005* (2013.01)

(58) Field of Classification Search
CPC ..... F25D 21/14; F25D 2321/1412; F25D 2321/1442; F25B 39/04; F28F 17/005; F28F 2230/00; F28F 2265/02; F28D 1/024
See application file for complete search history.

(56) References Cited

U.S. PATENT DOCUMENTS

| | | | | |
|---|---|---|---|---|
| 1,943,759 A * | 1/1934 | Fourness | F25B 39/04 62/305 |
| 3,225,563 A * | 12/1965 | Arieh | F25B 31/006 62/277 |
| 2014/0060772 A1* | 3/2014 | Lee | F24F 1/029 165/104.34 |

FOREIGN PATENT DOCUMENTS

| | | | |
|---|---|---|---|
| DE | 102011007412 A1 | 10/2012 | |
| DE | 102011007415 A1 | 10/2012 | |
| DE | 102015221659 A1 * | 5/2017 | F25D 21/14 |
| EP | 2157385 A2 * | 2/2010 | F25D 21/14 |

(Continued)

*Primary Examiner* — Joseph F Trpisovsky
(74) *Attorney, Agent, or Firm* — Laurence A. Greenberg; Werner H. Stemer; Ralph E. Locher

(57) ABSTRACT

A heat exchanger assembly for a refrigeration device has a condensation pan for receiving condensed water discharged from a cooling compartment of the refrigeration device. The assembly further includes a heat exchanger with a housing, a refrigerant line assembly arranged in an inlet opening of the housing, a fan which is arranged in an outlet opening of the housing, and a sealing plate which projects from the housing and protrudes into the condensation pan.

11 Claims, 3 Drawing Sheets

(56) References Cited

FOREIGN PATENT DOCUMENTS

| | | | | | |
|---|---|---|---|---|---|
| EP | 3473953 | A1 | | 4/2019 | |
| GB | 805286 | A | * | 12/1958 | ..... F25D 21/14 |

* cited by examiner

HEAT EXCHANGER ASSEMBLY FOR A REFRIGERATION DEVICE, AND REFRIGERATION DEVICE COMPRISING SAME

TECHNICAL FIELD

The present invention relates to a heat exchanger assembly for a refrigeration appliance and a refrigeration appliance, in particular a household refrigeration appliance, such as for example a refrigerator.

PRIOR ART

Refrigeration appliances, such as for example refrigerators, typically have a heat exchanger or condenser in order to condense compressed refrigerant. The heat exchanger is frequently arranged together with a condensation pan or evaporation pan in a machine compartment of the heat exchanger.

For example, DE 10 2011 007 412 A1 discloses a refrigeration appliance with a machine compartment in which a compressor, a heat exchanger and a condensation pan are arranged. The heat exchanger has a condenser and a fan, a cool air flow being conducted thereby via the condenser, wherein the condenser and fan are arranged in a common housing. The condensation pan is arranged on the compressor adjacent to the heat exchanger, wherein the cool air ejected by the heat exchanger is conducted via the condensation pan.

In the case of refrigeration appliances having such heat exchangers, it is desirable that the largest possible part of an air flow suctioned by the fan is available for cooling the condenser or the refrigerant.

SUMMARY OF THE INVENTION

One of the objects of the invention is to provide improved solutions for heat exchangers of refrigeration appliances, in particular to improve the efficiency of such heat exchangers.

This object is achieved by a heat exchanger assembly having the features as claimed and by a refrigeration appliance having the features as claimed.

According to a first aspect of the invention, a heat exchanger assembly for a refrigeration appliance is provided. The heat exchanger assembly comprises a condensation pan for receiving condensation discharged from a refrigerator compartment of the refrigeration appliance and a heat exchanger with a housing, a refrigerant pipe arrangement arranged in an inlet opening of the housing, a fan which is arranged in an outlet opening of the housing, and a sealing plate which projects from the housing and protrudes into the condensation pan.

According to a second aspect of the invention, a refrigeration appliance, in particular a household refrigeration appliance, such as for example a refrigerator or a fridge-freezer, is provided. The refrigeration appliance comprises a refrigerator compartment for storing goods to be refrigerated, such as for example food or beverages, a machine compartment, a heat exchanger assembly which is arranged in the machine compartment according to the first aspect of the invention and a condensation pipe for discharging condensation from the refrigerator compartment and which feeds into the condensation pan.

One idea on which the invention is based is to provide a sealing plate or panel on a housing of a heat exchanger in which a refrigerant pipe arrangement, for cooling and/or condensing a refrigerant, and a fan are arranged, said sealing plate or panel protruding from the housing into a condensation pan or evaporation pan. The housing may be produced, for example, in a tubular or channel-shaped manner, wherein the refrigerant pipe arrangement is arranged on a suction side of the fan. The fan suctions cool air through an inlet opening of the housing in which the refrigerant pipe arrangement is arranged, and ejects the cool air through an outlet opening of the housing. The panel or sealing plate protrudes from the housing between the inlet opening and the outlet opening in the direction of a bottom of the condensation pan and protrudes into the receiving volume defined by the condensation pan, such that a gap is formed between the bottom and an end of the panel.

When the receiving volume is sufficiently filled with condensation that the end of the sealing plate protrudes into the condensation, outside the housing of the heat exchanger an air-tight seal is obtained between the inlet opening and the outlet opening of the housing.

One of the advantages of the invention is that a bypass air flow or leakage air flow, which is conducted past the housing of the heat exchanger and thus past the refrigerant pipe arrangement, is reduced by the sealing plate protruding into the condensation pan. Thus the efficiency of the heat exchanger is improved.

Advantageous embodiments and developments emerge from the subclaims which refer back to the independent claims, in connection with the description and the figures.

According to some embodiments, it may be provided that the condensation pan has a bottom and a peripheral wall which projects from the bottom, wherein the sealing plate extends between opposing portions of the peripheral wall and a bottom gap is formed between the bottom and an end of the sealing plate. For example, the condensation pan may have two opposing side walls, the sealing plate extending therebetween. In particular, the sealing plate may bear against the side walls or the opposing portions of the peripheral wall. As a result, the seal is further improved and the leakage air flow may be further reduced.

According to some embodiments, it may be provided that the bottom gap has a clear width of between 1 mm and 10 mm. In this region a good compromise is obtained between tightness and production tolerances. In particular, it is possible to assemble the evaporation pan and heat exchanger in a simple manner. Optionally, the clear width of the bottom gap may also be between 2 mm and 3 mm. A relatively narrow bottom gap is produced in this region of the clear width, whereby the bottom gap is closed by liquid even in the case of a low level in the condensation container. Moreover, a narrow flow cross section is produced by the small clear width, said narrow flow cross section forming a high flow resistance for leakage flows even if the level in the condensation container is not sufficient to close the bottom gap. As a result the leakage air flow is further reduced.

According to some embodiments, it may be provided that the condensation pan has a sealing rib which projects from the bottom and which extends along the sealing plate between the opposing portions of the peripheral wall. The sealing rib thus divides the condensation pan into two sub-regions or sub-volumes. In particular, the sealing rib projects from a surface of the bottom at a height which is greater than the clear width of the bottom gap. Thus a type of siphon which is filled with condensation is formed between the sealing rib and sealing plate. As a result, the seal is further improved. Even when the level in the condensation pan does not reach the lower end of the sealing plate, the seal is further improved by the sealing rib since the drop in pressure of the leakage flow through the bottom gap and the gap between the sealing rib and sealing plate is increased.

According to some embodiments, it may be provided that an overlapping gap which is formed between the sealing plate and the sealing rib has a clear width of between 0.2 mm and 10 mm. Further optionally, the clear width of the overlapping gap may be between 0.3 mm and 5 mm. A relatively high flow resistance for a possible leakage air flow is produced in this region. At the same time, the sealing plate striking against the sealing rib due to potential vibrations is reliably counteracted and thereby noise development is advantageously reduced.

According to some embodiments, it may be provided that the sealing rib is configured in one piece with the bottom of the condensation pan. For example, the sealing rib and the condensation pan may be produced cost-effectively as plastic injection-molded parts.

According to some embodiments, it may be provided that the sealing plate is configured in one piece with the housing of the heat exchanger. For example, the sealing plate and the housing may be produced cost-effectively as plastic injection-molded parts.

According to some embodiments, it may be provided that the sealing plate is arranged in the region of the outlet opening of the housing of the heat exchanger.

According to some embodiments, the refrigeration appliance may be produced with a heat exchanger assembly in which the condensation pan has a sealing rib which projects from the bottom and which extends along the sealing plate between the opposing portions of the peripheral wall, as has been already described above, wherein a point at which the condensation pipe feeds into the condensation pan and the sealing plate are located on the same side of the sealing rib. In this manner, the sub-volume of the condensation pan into which the sealing plate protrudes is initially filled when condensation is introduced.

Relative to directional information and axes, in particular directional information and axes which relate to the path of physical structures, a path of an axis, a direction or a structure "along" another axis, direction or structure is understood to mean herein that these, in particular the resulting tangents in a respective position of the structures, in each case run at an angle of less than 45 degrees, preferably less than 30 degrees, and in particular preferably parallel to one another.

Relative to directional information and axes, in particular directional information and axes which relate to the path of physical structures, a path of an axis, a direction or a structure "transversely" to another axis, direction or structure is understood to mean herein that these, in particular the resulting tangents in a respective position of the structures, in each case run at an angle of greater than or equal to 45 degrees, preferably greater than or equal to 60 degrees, and in particular preferably perpendicular to one another.

Components or structures which are configured "in one piece", "in one part", "integrally" or "in a single piece" is generally understood to mean herein that these components or structures are present as a single part forming a material unit, and in particular are manufactured as such, wherein the one component or structure may be detached from the other component or structure without breaking the material cohesion.

BRIEF DESCRIPTION OF THE FIGS.

The invention is described hereinafter with reference to the figures of the drawings. From the figures.

In the figures, the same reference character denote components which are the same or functionally the same, unless specified otherwise.

DETAILED DESCRIPTION OF EXEMPLARY EMBODIMENTS

Figure 1:
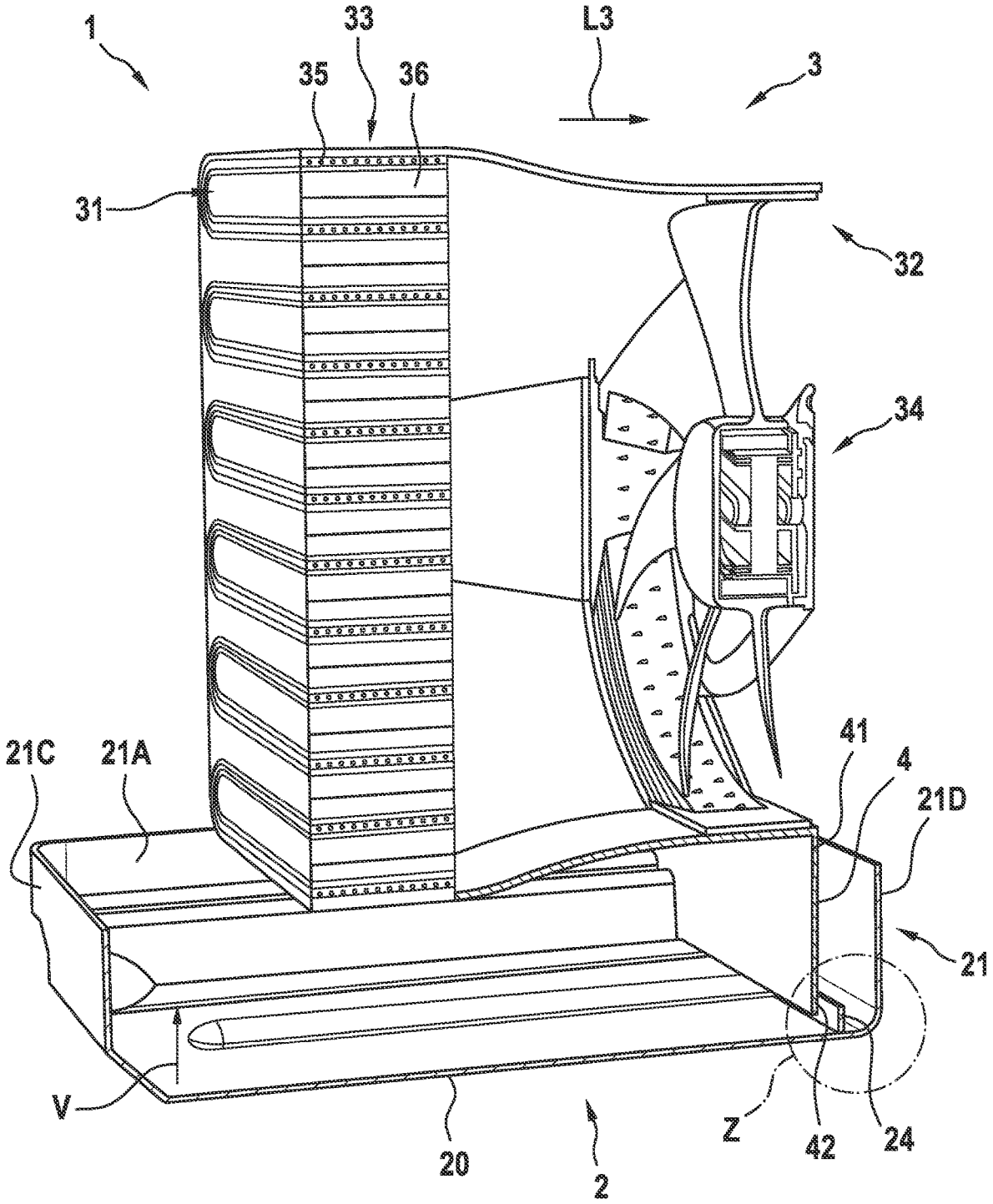
FIG. 1 shows a perspective sectional view of a heat exchanger assembly according to an exemplary embodiment of the invention.

FIG. 1 shows by way of example a sectional view of a heat exchanger assembly 1 for a refrigeration appliance 100, such as for example a refrigerator or a fridge-freezer. As shown by way of example in FIG. 1, the heat exchanger assembly 1 may have, in particular, a condensation pan or evaporation pan 2 and a heat exchanger 3.

Figure 4:
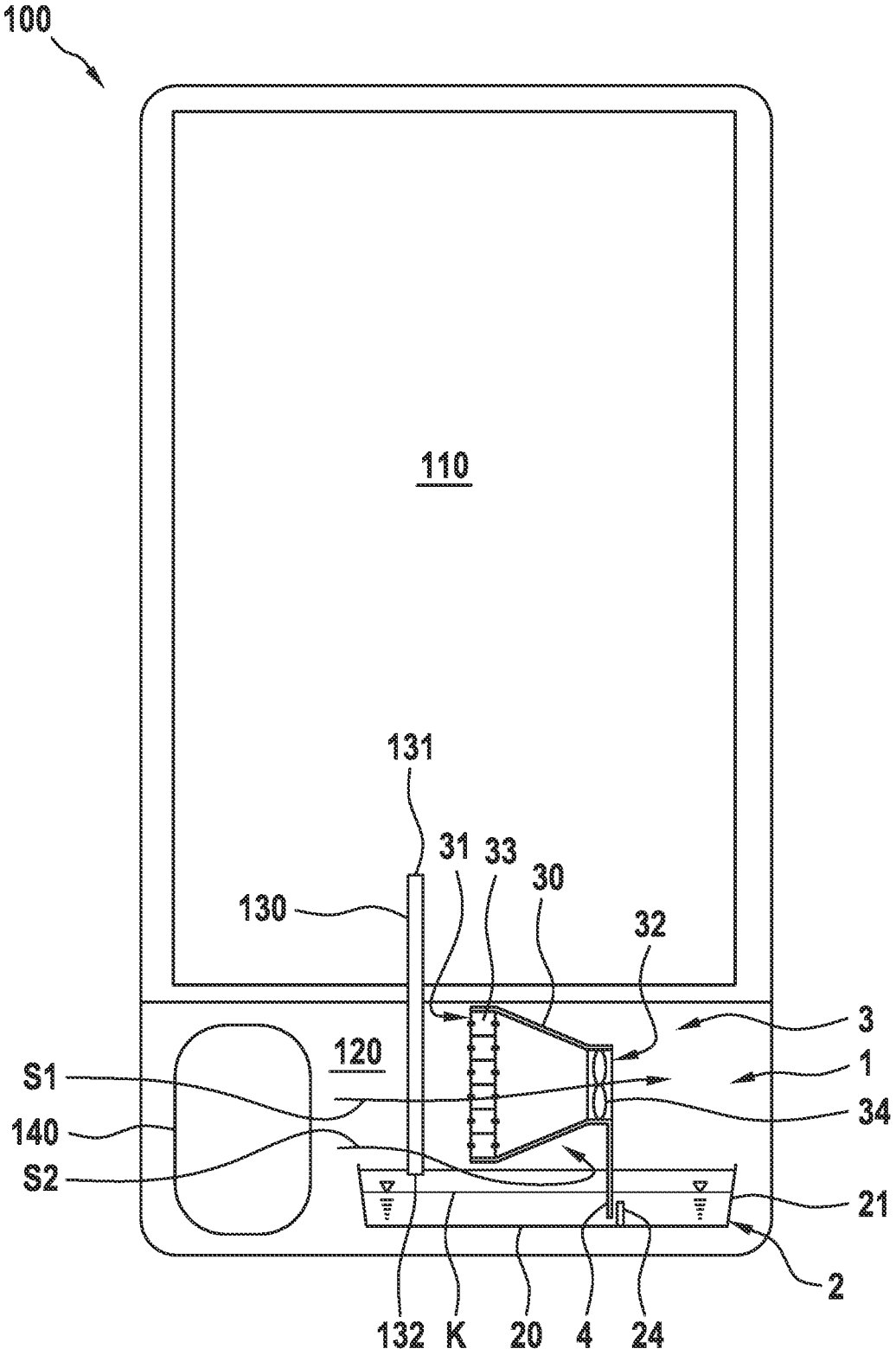
FIG. 4 shows a simplified schematic sectional view of a refrigeration appliance according to an exemplary embodiment of the invention.

FIG. 4 shows purely schematically a refrigeration appliance 100 in the form of a refrigerator having a refrigerator compartment 110 for storing goods to be refrigerated, such as for example food or beverages, a machine compartment 120 and a heat exchanger assembly 1. The refrigeration appliance 100 has a refrigerant circuit (not fully shown) in order to dissipate heat from the refrigerator compartment 110 by the circulation of a refrigerant and to cool the refrigerator compartment 110 thereby. The heat exchanger assembly 1 is part of the refrigerant circuit and serves to condense gaseous refrigerant compressed by a compressor 140 which may also be arranged in the machine compartment 120. As is also shown schematically in FIG. 4, a condensation pipe 130 may be provided, said condensation pipe connecting the interior of the refrigerator compartment 110 in a fluid-conducting manner to the machine compartment and feeding into the evaporation pan 2 of the heat exchanger assembly 1. Condensation which forms in the refrigerator compartment 110 may thus be discharged by the condensation pipe 130 into the condensation pan or evaporation pan 2.

Figure 3:
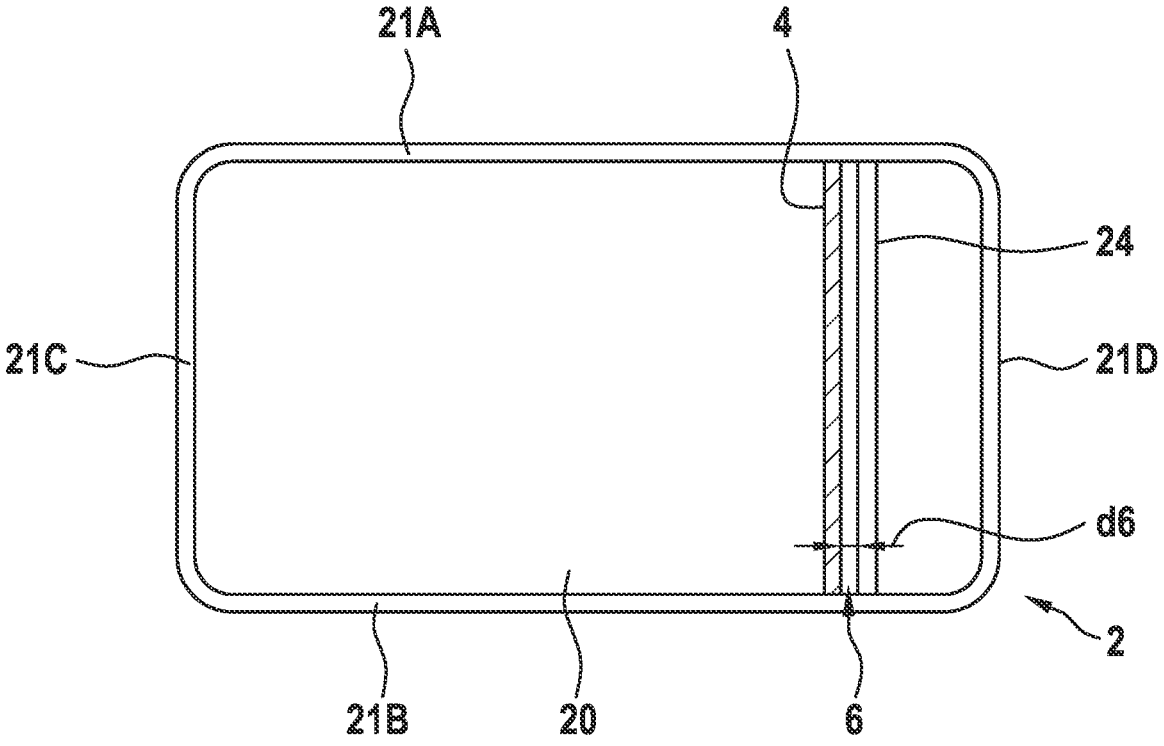
FIG. 3 shows a plan view of a bottom of a condensation pan of a heat exchanger assembly according to an exemplary embodiment of the invention, wherein a sealing plate is shown in section.

As shown by way of example in FIG. 1 and FIG. 3, which shows a plan view of the condensation pan 2, the condensation pan 2 may have a bottom 20 and a peripheral wall 21. The bottom 20 may be a flat plate, for example, extending in a planar manner. The peripheral wall 21 extends from the bottom 20 and projects in a vertical direction or height direction V from the bottom 20. The condensation pan 2 may have, for example, a rectangular periphery, optionally with rounded corners, as shown by way of example in FIG. 3. The peripheral wall 21 may be composed, for example, of a first side wall 21A, a second side wall 21B arranged opposite this first side wall, a third side wall 21C extending between the first and the second side wall 21A, 21B, and a fourth side wall 21D which is arranged opposite the third side wall 21C and which extends between the first and the second side wall 21A, 21B, as shown purely by way of example in FIG. 3. Naturally other peripheral shapes or designs of the peripheral wall 21, for example circular, are also conceivable. Generally, the bottom 20 and the peripheral wall 21 define a receiving volume of the condensation pan 2.

Figure 2:
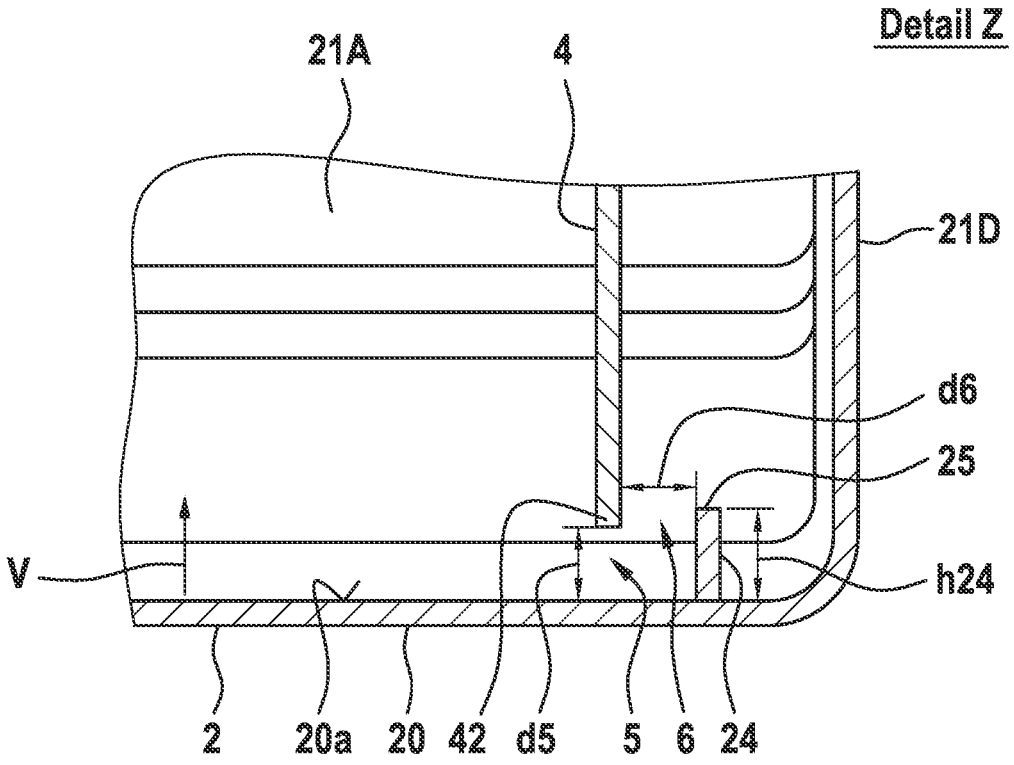
FIG. 2 shows a detailed view of the region of the heat exchanger assembly shown in FIG. 1 identified by the letter Z.

As is shown by way of example in FIGS. 1 to 3, the condensation pan 2 may have an optional sealing rib 24. As may be identified in particular in FIG. 2, the sealing rib 24 projects from the bottom 20 of the condensation pan 2. In particular, the sealing rib 24 projects in the vertical direction V at a height h24 from a surface 20*a* of the bottom 20. The height h24 may range, for example, between 2 mm and 15 mm. As shown by way of example in FIG. 2, the sealing rib 24 may have a rectangular cross section. However, other cross-sectional shapes are also conceivable. As shown schematically in FIG. 4, the optional sealing rib 24 extends between the first and the second side wall 21A, 21B of the condensation pan 2. Generally, the sealing rib 24 may extend between portions 21A, 21B of the peripheral wall 21 which oppose one another or which are spaced apart along the periphery.

The condensation pan or evaporation pan 2 may be produced, for example, from a plastic material, for example a thermoplastic material. The optional sealing rib 24 may be configured, for example, in one piece with the bottom 20 of the condensation pan 2.

As shown by way of example in FIG. 1 the heat exchanger 3 may have a housing 30, a refrigerant pipe arrangement 33 and a fan 34. The housing 30 may be configured, for example, in a tubular or channel-shaped manner and has an inlet opening 31 and an outlet opening 32 located opposite said inlet opening. As shown by way of example in FIG. 1, the inlet opening 31 may have, for example, a rectangular periphery. The outlet opening 32 may have, for example, a circular periphery. The inlet opening 31 and the outlet opening 32 are connected by a housing wall 30A defining the cross section of the housing 30. Thus the housing 30 extends as a whole in a housing longitudinal direction L3. The housing 30 may be composed of a plurality of housing parts or produced in one part as a continuous housing 30. The housing 30 may be formed, for example, from a plastic material.

The refrigerant pipe arrangement 33 may be produced, for example, as a MCHE unit, as is shown purely by way of example in FIG. 1. "MCHE" in this case is an abbreviation for the expression "Micro Channel Heat Exchanger". Generally, the refrigerant pipe arrangement 33 may have a plurality of refrigerant channels 35 for conducting the refrigerant. Further optionally, a plurality of cooling plates or cooling ribs 36 which are connected to the refrigerant channels 35 may be provided, in order to increase the surface area of the refrigerant pipe arrangement 33. Intermediate spaces for passing through cool air are provided between the refrigerant channels 35 and between the optional cooling ribs 36. As shown in FIG. 1, the refrigerant pipe arrangement 33 may be arranged, in particular, in the inlet opening 31 of the housing 30. As may be identified in FIG. 1, the refrigerant pipe arrangement 33 may be arranged, in particular, in the inlet opening 31 of the housing 30 such that it fills the inlet opening 31. The cross section or the periphery of the inlet opening 31 and the outer periphery of the refrigerant pipe arrangement 33 may be adapted to one another.

As shown by way of example in FIG. 1, the fan 34 is arranged in the outlet opening 32 of the housing 30. In particular, the fan 34 may be arranged in the outlet opening 32 such that the inlet opening 31 is located on a suction side of the fan 34. Thus the fan 34 may suction air through the inlet opening 31 and blow the air out through the outlet opening 32 of the housing 30. Thus air is suctioned by means of the fan 34 through the intermediate spaces of the refrigerant pipe arrangement 33 in order to cool the refrigerant pipe arrangement 33.

As also shown in FIG. 1, a sealing plate 4 which projects from the housing 30 of the heat exchanger 3 may be provided. In particular, the sealing plate 4 may project from the housing 30 transversely to the housing longitudinal direction L3. As shown by way of example in FIG. 1, the sealing plate 4 may be configured, in particular, as a flat plate 4. Generally, the sealing plate 4 is produced as a component which extends in a planar manner and which extends between a first end 41 which is located on the housing 30, in particular on the housing wall 30A, and a second end 42 located opposite the first end 41. As may be further identified in FIG. 1, the sealing plate 4 may be arranged, for example, in the region of the outlet opening 32 of the housing 30 of the heat exchanger 3. Optionally, the sealing plate 4 may be configured in one piece with the housing 30 of the heat exchanger 3.

As shown in FIG. 1, the heat exchanger 3 may be arranged opposite the condensation pan 2, in particular relative to the vertical direction V, such that the sealing plate 4 is located facing the condensation pan 2. As may be identified in FIG. 1, the sealing plate 4 protrudes into the condensation pan 2, whereby a bottom gap 5 is formed between the bottom 20 of the condensation pan 2 and the second end 42 of the sealing plate 4. The bottom gap 5 may have, for example, a clear width d5 of between 1 mm and 10 mm, in particular of between 2 mm and 3 mm. As may be identified in FIGS. 1 and 2, the peripheral wall 21 of the condensation pan 2 and the sealing plate 4 overlap relative to the vertical direction V.

As shown in FIG. 3, in particular, it may be provided that the sealing plate 21 extends over the entire distance between the opposing side walls 21A, 21B, in particular between the first and the second side wall 21A, 21B. The sealing plate 4 may extend between opposing portions 21A, 21B of the peripheral wall 21 irrespective of the periphery of the evaporation pan or condensation pan 2, which is defined by the peripheral wall 21.

As also shown in FIGS. 1 to 3, the sealing plate 4 and the optional sealing rib 24 may extend, in particular, along one another, optionally parallel to one another. As shown in FIG. 2, in particular, it may be provided that the sealing plate 4 and the sealing rib 24 overlap relative to the vertical direction V. In this case, an end 25 of the sealing rib 24 remote from the surface 20*a* of the bottom 20 projects further from the surface 20*a* of the bottom 20 than the distance between the second end 42 of the sealing plate 4 and the surface 20*a* of the bottom 20. For example, the clear width d5 of the bottom gap 5 may be less than the height h24 of the sealing rib 24.

As is shown by way of example in FIG. 2, an overlapping gap 6 is formed between the sealing plate 4 and the sealing rib 24 by the relative arrangement of the sealing plate 4 and the sealing rib 24 along one another. The overlapping gap 6 may have, for example, a clear width d6 ranging between 0.2 to 10 mm, preferably between 0.3 mm and 5 mm.

As shown by way of example and purely schematically in FIG. 4, the heat exchanger assembly 1 may be arranged in the machine compartment 120 of the refrigeration appliance 100. The condensation pipe 130 has a first end 131 which is connected to the interior of the refrigerator compartment 110. A second end 132 of the condensation pipe 130 feeds into the condensation pan 2. Thus condensation produced in the refrigerator compartment 110 is discharged into the condensation pan 2. If the condensation pan 2 has the optional sealing rib 24, the point at which the condensation pipe 130 feeds into the condensation pan 2 and the sealing plate 4 may be located on the same side of the sealing rib 6, as shown by way of example in FIG. 4. For example, it may be provided that the sealing rib 24 divides the receiving volume into two differently sized sub-volumes, as shown by way of example in FIGS. 1, 3 and 4. Depending on the structural boundary conditions, the sealing plate 24 may protrude into the larger or smaller sub-volume. In FIGS. 1 to 4 it is shown, for example, that the sealing plate 24 protrudes into the larger sub-volume. Accordingly, in FIG. 4 the condensation pipe 130 also feeds into the larger sub-volume.

As shown symbolically in FIG. 4 by the arrows S1 and S2, a cool air flow S1 is suctioned by the fan 34 through the inlet opening 31 and conducted via the refrigerant pipe arrangement 33 in order to cool the refrigerant. Since the sealing plate 4 protrudes into the condensation pan 2 filled with condensation K, a seal is improved outside the housing 30 between the inlet opening 31 and the outlet opening 32 of the housing 30. A leakage flow S2 is thus reduced or even entirely blocked, as shown symbolically in FIG. 4.

Whilst the present invention has been described above by way of example with reference to exemplary embodiments, it is not limited thereto, but may be modified in many different ways. In particular, combinations of the above exemplary embodiments are also conceivable.

LIST OF REFERENCE CHARACTERS

1 Heat exchanger assembly
2 Condensation pan
3 Heat exchanger
4 Sealing plate
5 Bottom gap
6 Overlapping gap
20 Bottom of condensation pan
21 Peripheral wall of condensation pan
21A First portion of peripheral wall/first side wall
21B Second portion of peripheral wall/second side wall
24 Sealing rib
25 End of sealing rib
30 Housing of heat exchanger
30A Housing wall
31 Inlet opening of housing
32 Outlet opening of housing
33 Refrigerant pipe arrangement
34 Fan
35 Refrigerant channels
36 Cooling ribs
41 First end of sealing plate
42 Second end of sealing plate
100 Refrigeration appliance
110 Refrigerator compartment
120 Machine compartment
130 Condensation pipe
131 First end of condensation pipe
132 Second end of condensation pipe
d5 Clear width of bottom gap
d6 Clear width of overlapping gap
h24 Height of sealing rib
K Condensation
S1 Cool air flow
S2 Leakage flow
V Vertical direction

The invention claimed is:

1. A heat exchanger assembly for a refrigeration appliance, the heat exchanger assembly comprising:

a condensation pan for receiving condensate discharged from a refrigerator compartment of the refrigeration appliance; and a heat exchanger with a housing, said housing having an inlet opening and an outlet opening;

a refrigerant pipe arrangement arranged in said inlet opening of said housing and a fan arranged in said outlet opening of said housing; and a sealing plate projecting from said housing and protruding into said condensation pan; and wherein said condensation pan has a bottom and a peripheral wall projecting from the bottom, wherein said sealing plate extends between opposing portions of said peripheral wall, and wherein a bottom gap is formed between said bottom and an end of said sealing plate.

2. The heat exchanger assembly according to claim 1, wherein said bottom gap has a clear width between 1 mm and 10 mm.

3. The heat exchanger assembly according to claim 2, wherein the clear width of said bottom gap, formed by a spacing distance between the end of said sealing plate and said bottom, lies between 2 mm and 3 mm.

4. The heat exchanger assembly according to claim 1, wherein said condensation pan has a sealing rib which projects from said bottom and which extends along said sealing plate between said opposing portions of said peripheral wall.

5. The heat exchanger assembly according to claim 4, wherein said sealing plate and said sealing rib are disposed to form an overlapping gap therebetween, and said overlapping gap between the sealing plate and the sealing rib has a clear width of between 0.2 mm and 10 mm.

6. The heat exchanger assembly according to claim 5, wherein said overlapping gap has a clear width of between 0.3 mm and 5 mm.

7. The heat exchanger assembly according to claim 4, wherein the sealing rib is configured in one piece with said bottom of said condensation pan.

8. The heat exchanger assembly according to claim 1, wherein the sealing plate is configured in one piece with said housing of said heat exchanger.

9. The heat exchanger assembly according to claim 1, wherein said sealing plate is arranged in a region of said outlet opening of said housing of said heat exchanger.

10. A refrigeration appliance, comprising:

a refrigerator compartment for storing goods to be refrigerated;

a machine compartment;

a heat exchanger assembly according to claim 1 disposed in said machine compartment; and a condensation pipe for discharging condensate from the refrigerator compartment and feeding into the condensation pan.

11. The refrigeration appliance according to claim 10, wherein:

the bottom gap formed between said bottom and an end of said sealing plate has a clear width between 1 mm and 10 mm;

said condensation pan has a sealing rib which projects from said bottom and which extends along said sealing plate between said opposing portions of said peripheral wall; and a point at which said condensation pipe feeds into said condensation pan and said sealing plate are located on a same side of said sealing rib.

* * * * *